United States Patent [19]

Reynolds

[11] Patent Number: 4,785,623

[45] Date of Patent: Nov. 22, 1988

[54] COMBUSTOR SEAL AND SUPPORT

[75] Inventor: Harold G. Reynolds, West Palm Beach, Fla.

[73] Assignee: United Technologies Corporation, Hartford, Conn.

[21] Appl. No.: 131,056

[22] Filed: Dec. 9, 1987

[51] Int. Cl.[4] ..... F02C 3/14; F02C 7/20

[52] U.S. Cl. ..... 60/39.32; 60/39.36

[58] Field of Search ..... 60/39.36, 39.32, 39.31, 60/751–760

[56] References Cited

U.S. PATENT DOCUMENTS

| | | | |
|---|---|---|---|
| 2,720,080 | 10/1955 | Oulianoff et al. | 60/751 |
| 3,670,497 | 6/1972 | Sheldon | 60/39.32 |
| 3,842,595 | 10/1974 | Smith et al. | 60/39.36 |
| 4,149,373 | 4/1979 | Jones et al. | 60/39.36 |

FOREIGN PATENT DOCUMENTS

| | | | |
|---|---|---|---|
| 2422037 | 12/1979 | France | 60/752 |
| 2119861 | 11/1983 | United Kingdom | 60/757 |

*Primary Examiner*—Donald E. Stout

*Attorney, Agent, or Firm*—Edward L. Kochey, Jr.

[57] ABSTRACT

A combustor liner is supported from a surrounding diffuser case, and restricted from upstream movement by radial surfaces of complimentary radial lugs. A split seal ring seals against the downstream outside edge of the liner and the upstream facing surface of a downstream located blade platform. An outwardly extending flange cooperates with a waveform washer to bias the seat against the blade platform. The flange cooperates with the seal ring itself to restrict downstream movement of the liner.

5 Claims, 2 Drawing Sheets

COMBUSTOR SEAL AND SUPPORT

The Government has rights in this invention pursuant to a contract awarded by the Department of the Air Force.

TECHNICAL FIELD

The invention relates to gas turbine engines and in particular to supporting and sealing a combustion liner therein.

BACKGROUND OF THE INVENTION

Combustion liners in a gas turbine engine provide a combustion chamber and deliver hot gas to the turbine. The liner must be supported in a manner to accept gas loading and aircraft G-loads while tolerating expansion differentials caused by temperature.

Support of the liner near the upstream end increases the expansion movement of the downstream end with respect to the turbine, resulting in increased sealing difficulties at this high temperature zone.

Downstream end support, or aft mounting, of the liner has consisted of a long conical flange permanently attached to the combustor and bolted to the diffuser case. This structure is life limited by virtue of the inherent high stresses, particularly in areas near the flowpath where cooling holes are required to purge the gap between the combustor and the turbine vane. The conical flange also tends to block access to the aft panel attachments. Another method is a fish mouth seal which is susceptable to wear and does not provide axial support.

SUMMARY OF THE INVENTION

A combustion liner forming an annular combustion chamber has an outwardly extending circumferential flange near its downstream end. A concentric diffuser case includes a plurality of inwardly extending diffuser lugs at the same location. The flange carries a plurality of liner lugs which slideably engage the diffuser lugs along radial surfaces on both the circumferentially facing and downstream facing sides. A vane platform is located coaxial with and downstream of the combustion liner. A seal ring surrounds the combustion liner and is in sliding contact with it, with the seal ring being U-shaped in cross section and having the downstream side sealing against the edge of the vane platform. A waveform spring washer is located within the opening of the U-shaped seal ring and functions to axially bias the seal ring against the edge of the vane platform.

The opening in the seal is of sufficient depth to prevent excess compression of the spring resulting in a permanent set. The continuous spring also functions to retain fragments of the seal in the event of breakage of the seal ring.

In one embodiment the flange has an additional axially extending portion so that the seal ring fits between this portion and the surface of the liner. This increases resistance to air leakage between the seal ring and the combustion liner.

DESCRIPTION OF THE PREFERRED EMBODIMENT

Figure 1:
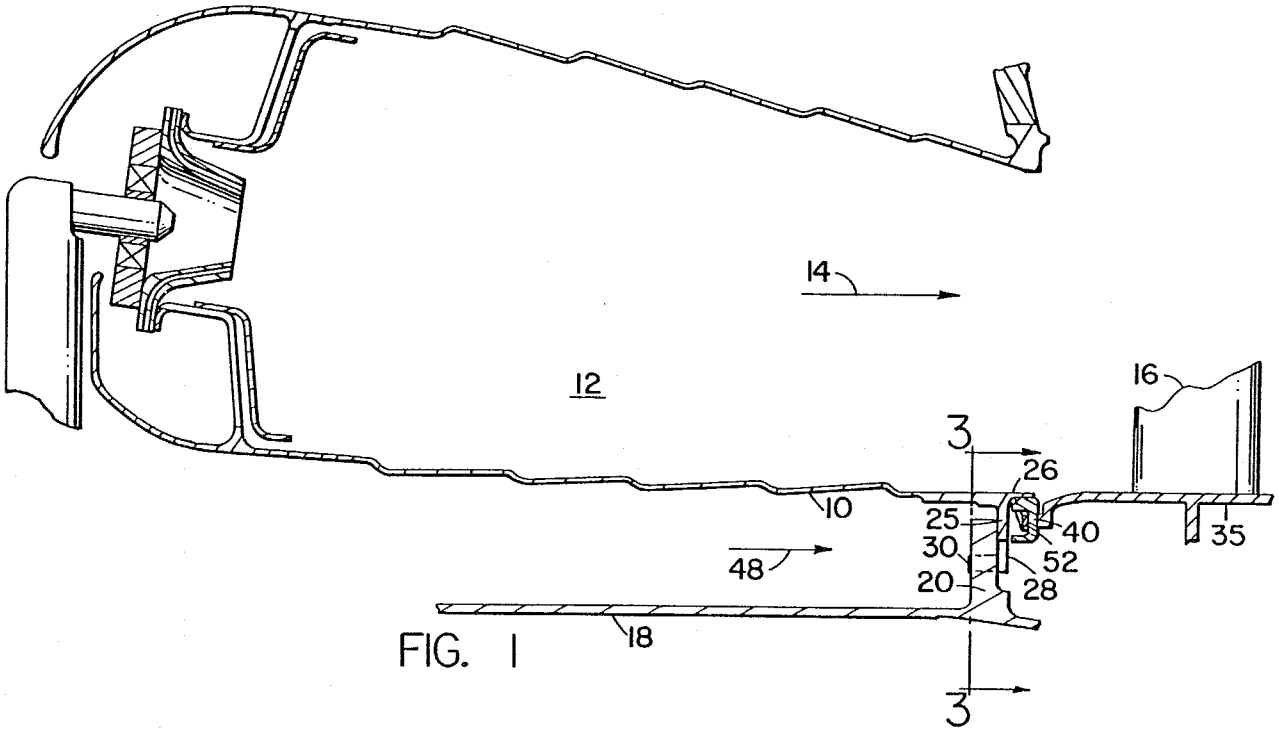
FIG. 1 is a sectional view of the combustion liner supported within a diffuser casing.

Combustion liner 10 forms an annular combustion space 12 through which a flow of gases 14 occurs. The gas flowing from the combustion chamber passes over the inlet vane 16 of a gas turbine. A diffuser case 18 concentrically surrounds the combustion liner 10.

The diffuser case 18 has arranged around its inner periphery 12 radially inwardly extending lugs 20. Each lug has two circumferentially extending surfaces 22 and a radially extending downstream facing surface 24.

The combustion liner 10 has an outwardly extending flange 25 adjacent to the downstream end 26 of the liner. The flange carries two outwardly extending liner lugs 28 located at the corresponding 12 locations of the diffuser case lugs 20. The two arms 30 of each liner lug straddle the diffuser lug 20 so as to bear against the opposing circumferentially facing surfaces. An upstream facing surface 32 on the liner lug abuts a downstream facing surface 34 of the diffuser lug. Accordingly, the liner 10 is prevented from moving upstream by the interface between surfaces 32 and 34. Circumferential and radial restraint of the liner is provided by the interaction of the circumferentially facing axially extending surfaces 22 and 23 of the diffuser and liner lugs, respectively Assuming a downwardly acting force on the liner with respect to the diffuser it can be seen that the lugs at approximately the horizontal or 90 degree locations prevent relative vertical movement of the two components. These lugs would then have surfaces in direct compression. Those surfaces at an angle, for instance 45 degrees, will have not only a component of force normal to the surface but also a component tending to slide. The friction of this non-normal force provides some movement and damping of liner vibrations. The same result accrues for forces in any other radial direction.

A plurality of vanes 16 are supported on the vane platform 35 which has an upstream edge 36. This platform 35 is in turn structurally supported by the diffuser case 18.

A seal ring 40 is U-shaped in cross section and is a split ring being inwardly biased with surface 42 of the ring bearing against surface 44 of an extension 46 of the liner. This provides a seal limiting flow of cooling air 48 past the seal into combustion chamber 12. Within the U-shaped opening 50 of the seal ring there is located a waveform washer 52, which biases the seal 40 toward the edge 36 of the vane platform. The waveform washer is a single continuous circumferential ring of approximately 30 inches in diameter with the waveform having a pitch of about 5 inches. The undeformed height of the washer is 0.26 inches with the design spring load at 0.21 inches of about 80 pounds. The depth of the recess within the seal ring is approximately 0.16 inches. Accordingly, should the seal ring 40 completely abut the surface 54 of the flange the waveform washer will not be overstressed beyond its elastic limit which would cause it to be permanently deformed. The spring, however, operates as a biasing means to continually urge the seal 40 against the edge 36 of the blade platform 35, thereby restricting any flow of cooling air 48 into the main gas flow 14.

The liner 10 is restrained from movement in the downstream or aft direction by the seal ring 40. Surface 54 of flange 25 abuts the seal ring 40 which in turn abuts the edge 36 cf the blade platform 35 in the presence of a downstream force.

The liner is in its extreme upstream position when surface 32 of liner lugs 28 bears against surface 24 of diffuser lugs 20. It is in its extreme downstream position when the surface 54 of flange abuts the seal ring which abuts edge 36 of the vane platform. This distance is represented by the clearance 56 between the seal ring and the flange surface in the installed upstream location. The axial overlap of diffuser lugs 20 and liner lugs 28 must substantially exceed this amount to retain sufficient bearing surface when the liner has shifted to its downstream extreme.

The liner is supported by a lightweight structure which permits radial and longitudinal expansion with low stresses. Damping of liner vibrations is also accomplished. A durable resilient seal structure seals cooling air from leakage into the gas flow in a manner tolerant of wear and not over sensitive to handling damage. The axial support in the downstream direction is provided without overstressing the biasing spring.

Figure 4:
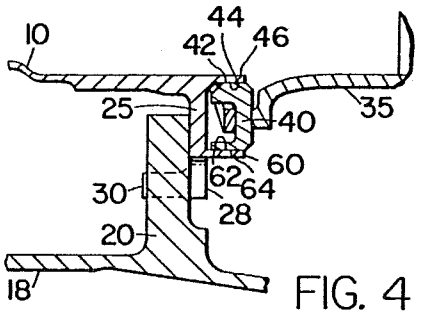
FIG. 4 is an alternate embodiment.
Figure 3:
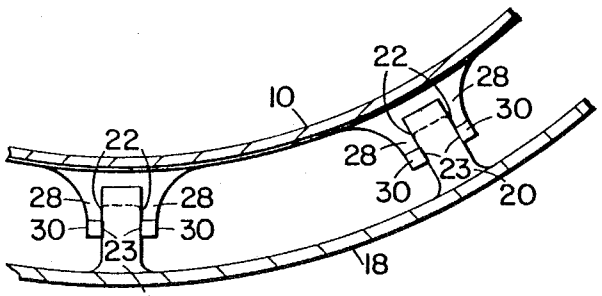
FIG. 3 is an end sectional view showing the support locations.
Figure 2:
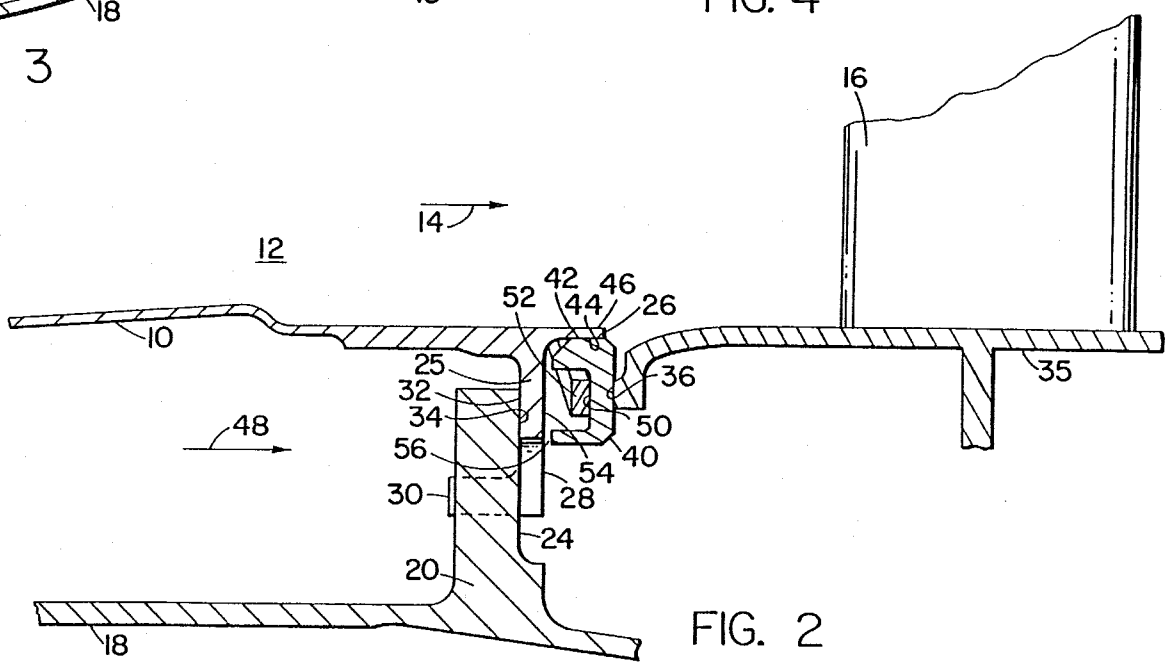
FIG. 2 is an expanded sectional view at a support location.

In an alternate embodiment shown in FIG. 4 the flange 25 includes a circumferential axial extension 60 spaced from the downstream extension 46 of the liner 10. The seal 40 is slideably constrained between the extension 46 and the extension 60. The additional restriction in the space between the surface 62 of the annular extension and surface 64 of the seal acts to further decrease air leakage passing between the seal 40 and the liner 10 into the gas flow 14.

I claim:

1. In a gas turbine engine an apparatus for supporting a combustor liner having gas flow therethrough;

a combustor liner forming an annular combustor space;

an outwardly extending circumferential flange located on said- combustor liner adjacent to the downstream end of said liner;

a diffuser case concentrically surrounding said liner;

a plurality of inwardly extending diffuser lugs mounted on said diffuser case;

a plurality of outwardly extending liner lugs mounted on said flange and sliding engaging said diffuser lugs along circumferentially facing and downstream facing radial surfaces;

a vane platform located coaxial with and downstream of said combustor liner and having an upstream edge;

a seal ring surrounding and in axially sliding contact with said combustor liner downstream of said flange;

said seal ring being U-shaped in cross section and being a resilient inwardly biased split ring;

said seal ring having a radial sealing surface in abutable contact with said upstream edge of said diffuser case and;

axial biasing means urging said seal ring into sealing contact with said upstream edge of said vane platform.

2. An apparatus as in claim 1:

said biasing means comprising a circumferentially continuous waveform washer.

3. An apparatus as in claim 2:

said U-shaped seal having a U-shaped spring receiving opening of sufficient depth to permit full compression of said biasing means to said depth without exceeding the elastic limit of said biasing means.

4. An apparatus as in claim 3:

the axial overlap of said liner lugs and said diffuser lugs with the liner at its upstream location substantially exceeding the axial clearance between said seal ring and said flange with said seal ring in contact with said upstream edge of said vane platform.

5. An apparatus as in claim 1:

said flange including a circumferential axial extension spaced from said combustion liner; and said seal ring slideably constrained between said extension and said liner, whereby the annular space between said seal and said extension aids in reducing leakage between said seal and said liner.

* * * * *